US009664371B2

(12) United States Patent
Sprankle et al.

(10) Patent No.: US 9,664,371 B2
(45) Date of Patent: May 30, 2017

(54) LAMP HEAD ASSEMBLIES AND METHODS OF ASSEMBLING THE SAME

(71) Applicant: Heraeus Noblelight America LLC, Gaithersburg, MD (US)

(72) Inventors: David Sprankle, Hagerstown, MD (US); Ruben Manikkam, Clarksburg, MD (US)

(73) Assignee: Heraeus Noblelight America LLC, Gaithersburg, MD (US)

( * ) Notice: Subject to any disclaimer, the term of this patent is extended or adjusted under 35 U.S.C. 154(b) by 0 days.

(21) Appl. No.: 14/994,462

(22) Filed: Jan. 13, 2016

(65) Prior Publication Data

US 2016/0209020 A1 Jul. 21, 2016

Related U.S. Application Data

(60) Provisional application No. 62/103,959, filed on Jan. 15, 2015.

(51) Int. Cl.
*G21K 5/00* (2006.01)
*F21V 23/00* (2015.01)
(Continued)

(52) U.S. Cl.
CPC ..... *F21V 29/713* (2015.01); *F21V 23/003* (2013.01); *F21V 23/006* (2013.01);
(Continued)

(58) Field of Classification Search
CPC ..... G21K 5/00; F21V 29/713; F21V 29/56; F21V 23/003; F21Y 2101/02
(Continued)

(56) References Cited

U.S. PATENT DOCUMENTS 4,710,638 A 12/1987 Wood
8,872,137 B2 10/2014 Childers
(Continued)

FOREIGN PATENT DOCUMENTS

CN 102518971 6/2012
DE 102011083698 4/2013
(Continued)

OTHER PUBLICATIONS

International Search Report for International Patent Application No. PCT/US2016/013355, dated Jun. 6, 2016.

*Primary Examiner* — Nicole Ippolito
(74) *Attorney, Agent, or Firm* — Stradley Ronon Stevens & Young, LLP

(57) ABSTRACT

A lamp head assembly is provided. The lamp head assembly includes a thermally conductive block, an inlet cooling fluid pipe coupled to the thermally conductive block such that a cooling fluid is configured to pass from the inlet cooling fluid pipe to the thermally conductive block, and a metal heat exchanger secured to the thermally conductive block. The metal heat exchanger defines a plurality of internal channels to distribute cooling fluid provided by the inlet cooling fluid pipe. The metal heat exchanger is secured to the thermally conductive block such that the cooling fluid is configured to pass from the thermally conductive block to the plurality of internal channels defined by the metal heat exchanger. The lamp head assembly also includes a plurality of light producing elements secured to the metal heat exchanger.

20 Claims, 10 Drawing Sheets

(51) Int. Cl.

| | |
|---|---|
| ***F21V 29/71*** | (2015.01) |
| ***F21V 29/56*** | (2015.01) |
| ***F21V 29/58*** | (2015.01) |
| *F21W 111/00* | (2006.01) |
| *F21Y 115/10* | (2016.01) |

(52) U.S. Cl.
CPC ..... *F21V 29/56* (2015.01); *F21V 29/59* (2015.01); *F21W 2111/00* (2013.01); *F21Y 2115/10* (2016.08)

(58) Field of Classification Search
USPC ..... 250/493.1, 494.1, 504 R, 504 H
See application file for complete search history.

(56) References Cited

U.S. PATENT DOCUMENTS

| | | | | |
|---|---|---|---|---|
| 2006/0214092 | A1 | 9/2006 | Kinoshita et al. | |
| 2011/0147356 | A1 | 6/2011 | Leonhardt et al. | |
| 2013/0187063 | A1 | 7/2013 | Dahm et al. | |
| 2014/0014857 | A1 | 1/2014 | Martinez et al. | |
| 2014/0131755 | A1 | 5/2014 | Owen et al. | |
| 2014/0265810 | A1* | 9/2014 | Livesay | F21V 29/006 313/12 |

FOREIGN PATENT DOCUMENTS

| | | |
|---|---|---|
| JP | 2009065127 | 3/2009 |
| WO | 2009144449 | 12/2009 |

* cited by examiner

LAMP HEAD ASSEMBLIES AND METHODS OF ASSEMBLING THE SAME

CROSS-REFERENCE TO RELATED APPLICATION

This application claims the benefit of U.S. Provisional Patent Application No. 62/103,959, filed Jan. 15, 2015, the content of which is incorporated herein by reference.

FIELD

The invention relates to lamp head assemblies for liquid cooled lamp systems, and more particularly, to such lamp head assemblies including metal body portions.

BACKGROUND

Lamp systems including light producing elements (e.g., ultraviolet radiation LEDs, also known as UV LEDs) are used in connection with many applications such as, for example, UV curing applications (e.g., UV curing of inks, bonding agents such as adhesives, coatings, etc.). Certain light producing devices (e.g., a group of UV LEDs) produce a substantial amount of heat, and are typically cooled using a cooling fluid.

For example, the cooling fluid may be water provided by a chiller system. The assembly that carries the light producing elements, and that provides for the distribution of the cooling fluid to the area of the light producing elements, may be termed a "lamp head assembly".

Lamp head assemblies serve a number of purposes including the support of the light producing devices, the distribution and control of energy for powering the light producing devices, and the distribution of the cooling fluid. There are many challenges in the development of lamp head assemblies including cost, time of production, energy efficiency, reliability (e.g., reliability in terms of containing and the cooling fluid), amongst others.

Thus, it would be desirable to provide improved lamp head assemblies, and methods of assembling and operating such lamp head assemblies.

SUMMARY

According to an exemplary embodiment of the invention, a lamp head assembly is provided. The lamp head assembly includes a thermally conductive block, an inlet cooling fluid pipe coupled to the thermally conductive block such that a cooling fluid is configured to pass from the inlet cooling fluid pipe to the thermally conductive block, and a metal heat exchanger secured to the thermally conductive block. The metal heat exchanger defines a plurality of internal channels to distribute cooling fluid provided by the inlet cooling fluid pipe. The metal heat exchanger is secured to the thermally conductive block such that the cooling fluid is configured to pass from the thermally conductive block to the plurality of internal channels defined by the metal heat exchanger. The lamp head assembly also includes a plurality of light producing elements secured to the metal heat exchanger.

According to another exemplary embodiment of the invention, a method of assembling a lamp head assembly is provided. The method includes the steps of: (a) coupling an inlet cooling fluid pipe to a thermally conductive block such that a cooling fluid is configured to pass from the inlet cooling fluid pipe to the thermally conductive block; (b) securing a metal heat exchanger to the thermally conductive block, the metal heat exchanger defining a plurality of internal channels to distribute cooling fluid provided by the inlet cooling fluid pipe, the metal heat exchanger being secured to the thermally conductive block such that the cooling fluid is configured to pass from the thermally conductive block to the plurality of internal channels defined by the metal heat exchanger; and (c) securing a plurality of light producing elements to the metal heat exchanger.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawings are the following figures.

DETAILED DESCRIPTION

In accordance with certain exemplary embodiments of the invention, a metal lamp body assembly for liquid cooled lamps (i.e., a lamp head assembly) is provided, for example, that uses an optical source with a Lambertian (cosine) distribution of the output light. The lamp head assembly may include a metal heat exchanger (e.g., a copper coolant block) to which a UV LED strip (or another arrangement of light producing devices) is mounted. Inlet and outlet cooling fluid pipes (e.g., formed from copper tubing, formed from stainless steel stubing, etc.) supply a cooling fluid to the metal heat exchanger, for example, through a thermally conductive block, to cool the light source.

The cooling fluid (configured to remove heat produced by the light producing elements, such as UV LED elements) may be provided in a closed loop configuration (e.g., a sealed water system), where a water chiller provides the cooling fluid to the lamp head assembly, and then the cooling fluid returns to the water chiller after providing the cooling effect.

Further, the lamp head assembly may include a pair of thermally conductive plates (e.g., solid aluminum plates) mounted on the inlet and outlet cooling fluid pipes for transferring heat from the circuit boards (mounted on the pair of thermally conductive plates) into the inlet and the outlet cooling fluid pipes. The inlet and outlet cooling fluid pipes (which may include copper tubes and copper tube fittings, or which may be formed by other materials such as stainless steel) and the thermally conductive block (which may also be formed of copper) may be joined by soldering, brazing, welding, etc. to desirably provide a leak free assembly capable of handling a substantial fluid pressure (e.g., in excess of 100 psi).

The lamp head assemblies described herein include a limited number of parts that are designed to be easily manufacturable at a low-cost. The metal lamp head body assembly is easy to assemble. Simple cooling fluid pressure testing (e.g., to test the strength of the joints) may be performed before assembly of the metal lamp head body assembly to the remaining lamp assembly components.

With the simple design, and a limited number of components, a substantial cost savings may be provided over alternative solutions. Additional benefits may include a robust joining, and sealing, of cooling fluid assembly joints, with a design that facilitates easy pressure testing of the cooling fluid elements. Also, in embodiments including metal (e.g., aluminum) thermally conductive plates in contact with the inlet and outlet cooling fluid pipes, electrical circuitry may be bonded directly to a surface of the thermally conductive plates (i.e., to an exterior surface of the plates away from the cooling fluid pipes).

Figure 1A:
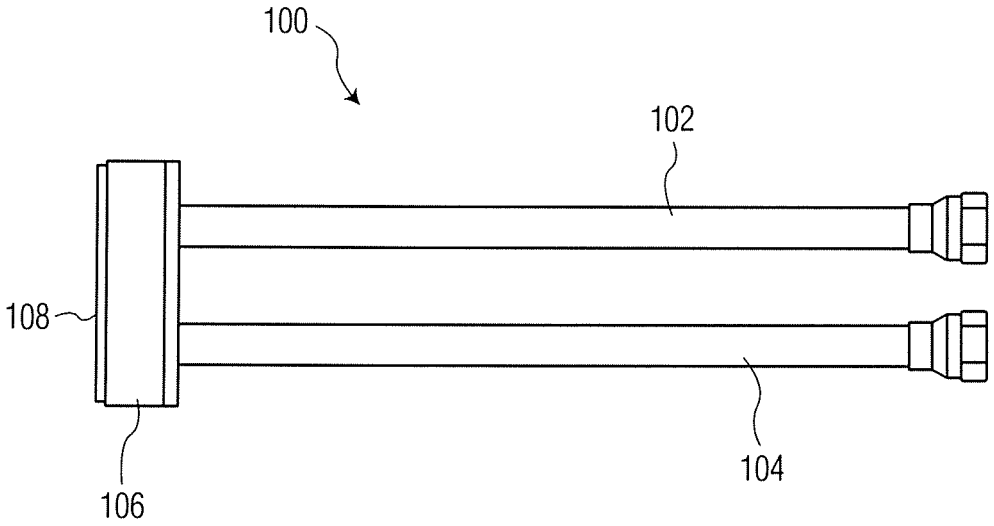
FIG. 1A is a top view of a lamp head assembly in accordance with an exemplary embodiment of the invention.
Figure 1B:
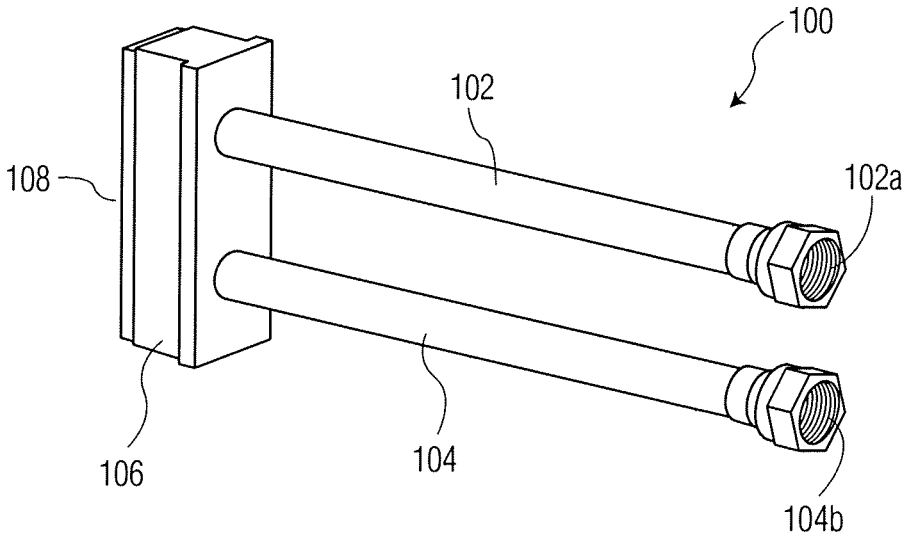
FIG. 1B is a top perspective view of the lamp head assembly of FIG. 1A in accordance with an exemplary embodiment of the invention.
Figure 1C:
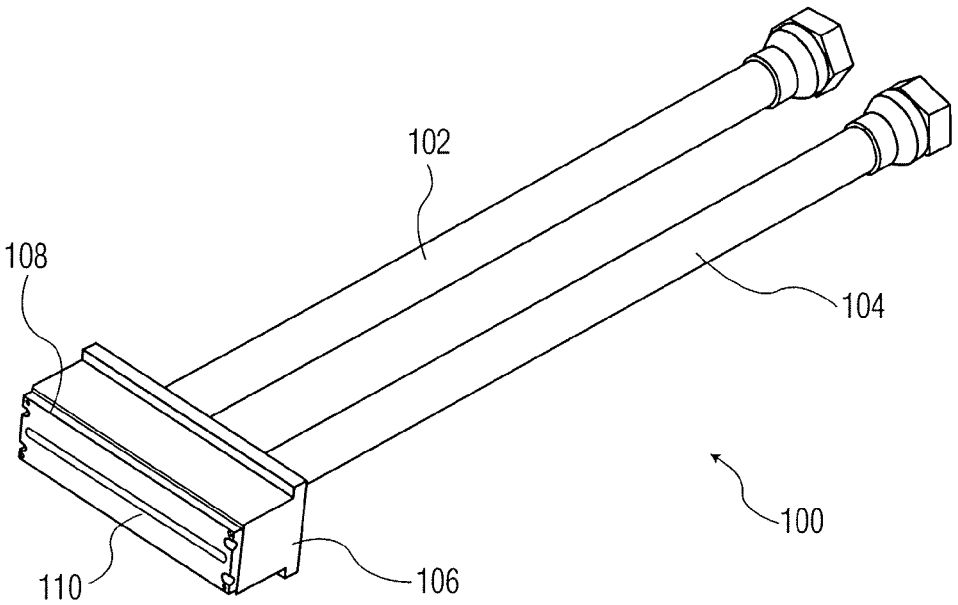
FIG. 1C is another top perspective view of the lamp head assembly of FIG. 1A in accordance with an exemplary embodiment of the invention.

FIGS. 1A-1C provide various views of a lamp head assembly 100. Lamp head assembly 100 includes a thermally conductive block 106 (e.g., a copper coolant block). An inlet cooling fluid pipe 102, and an outlet cooling fluid pipe 104, are coupled to thermally conductive block 106. For example, each of inlet cooling fluid pipe 102 and outlet cooling fluid pipe 104 may be formed of copper (or another material such as stainless steel), and may be coupled to thermally conductive block 106 using at least one of soldering, brazing, welding, etc. As shown in FIG. 1B, an opposite end of each of inlet cooling fluid pipe 102 and outlet cooling fluid pipe 104 includes tube fittings 102*a*, 104*a* (e.g., threaded copper tube fittings). Lamp head assembly 100 also includes a metal heat exchanger 108 secured to thermally conductive block 106. A plurality of light producing elements 110 are secured to metal heat exchanger 108, as shown in FIG. 1C. Although the plurality of light producing elements 110 are shown as a strip in FIG. 1C for simplicity, it is understood that the plurality of light producing elements 110 may be arranged in any desired configuration. The plurality of light producing elements 110 may be a plurality of ultraviolet (UV) light emitting diode (LED) devices (i.e., UV LED die). Metal heat exchanger 108 defines a plurality of internal channels (not visible in FIGS. 1A-1C) to receive and distribute cooling fluid provided by inlet cooling fluid pipe 102, that first passes through thermally conductive block 106.

The plurality of light producing elements 110 tend to produce excessive heat during operation. A cooling fluid (e.g., cooling water provided by a chiller, not shown) enters lamp head assembly 100 through inlet cooling fluid pipe 102. From inlet cooling fluid pipe 102 the cooling fluid enters thermally conductive block 106, from which it enters the plurality of internal channels defined by metal heat exchanger 108. The plurality of internal channels are designed to bring the cooling fluid in proximity of the plurality of light producing elements 110 to provide a cooling effect. From the plurality of cooling channels, the cooling fluid re-enters metal heat exchanger 108. The cooling fluid then travels back to a cooling fluid source (e.g., a water chiller system) via outlet cooling fluid pipe 104.

Figure 2A:
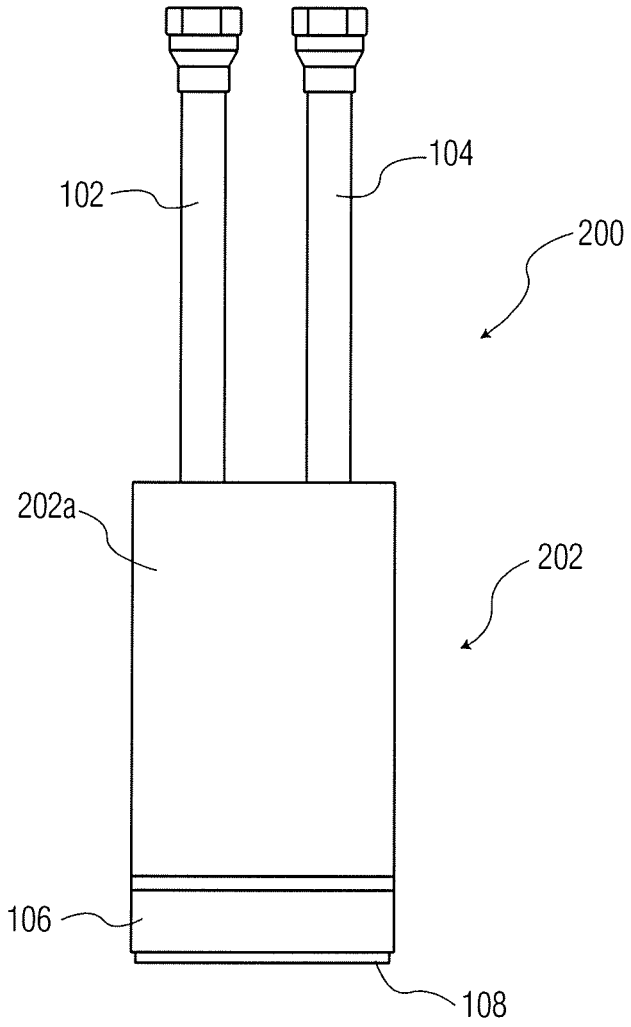
FIG. 2A is a top view of a lamp head assembly in accordance with another exemplary embodiment of the invention.
Figure 2B:
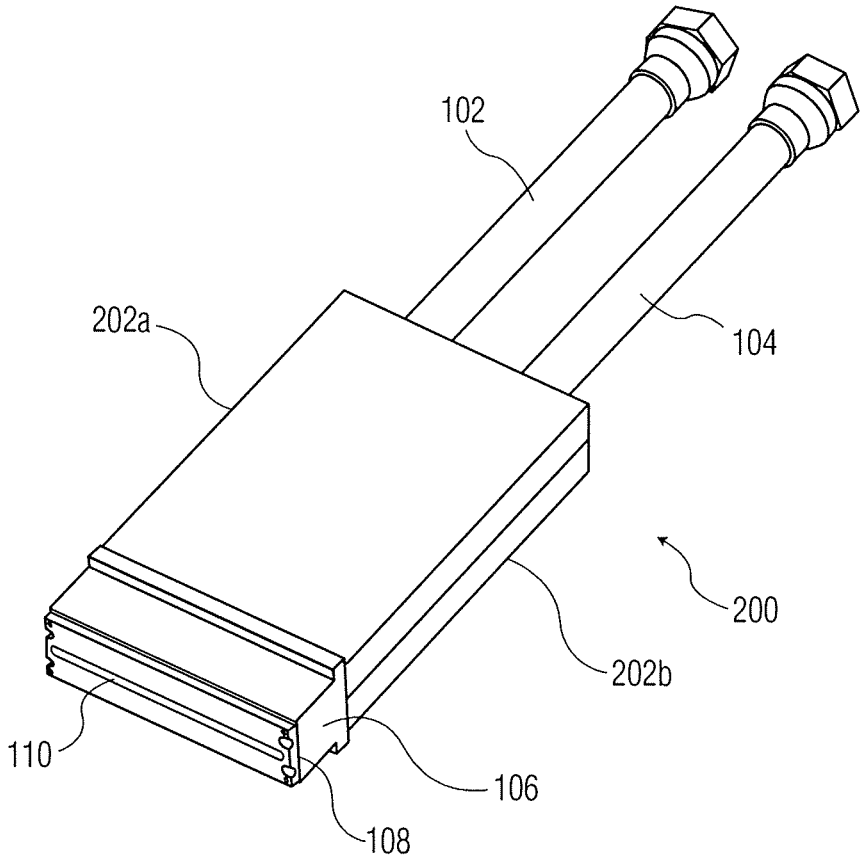
FIG. 2B is a top perspective view of the lamp head assembly of FIG. 2A in accordance with an exemplary embodiment of the invention.
Figure 2C:
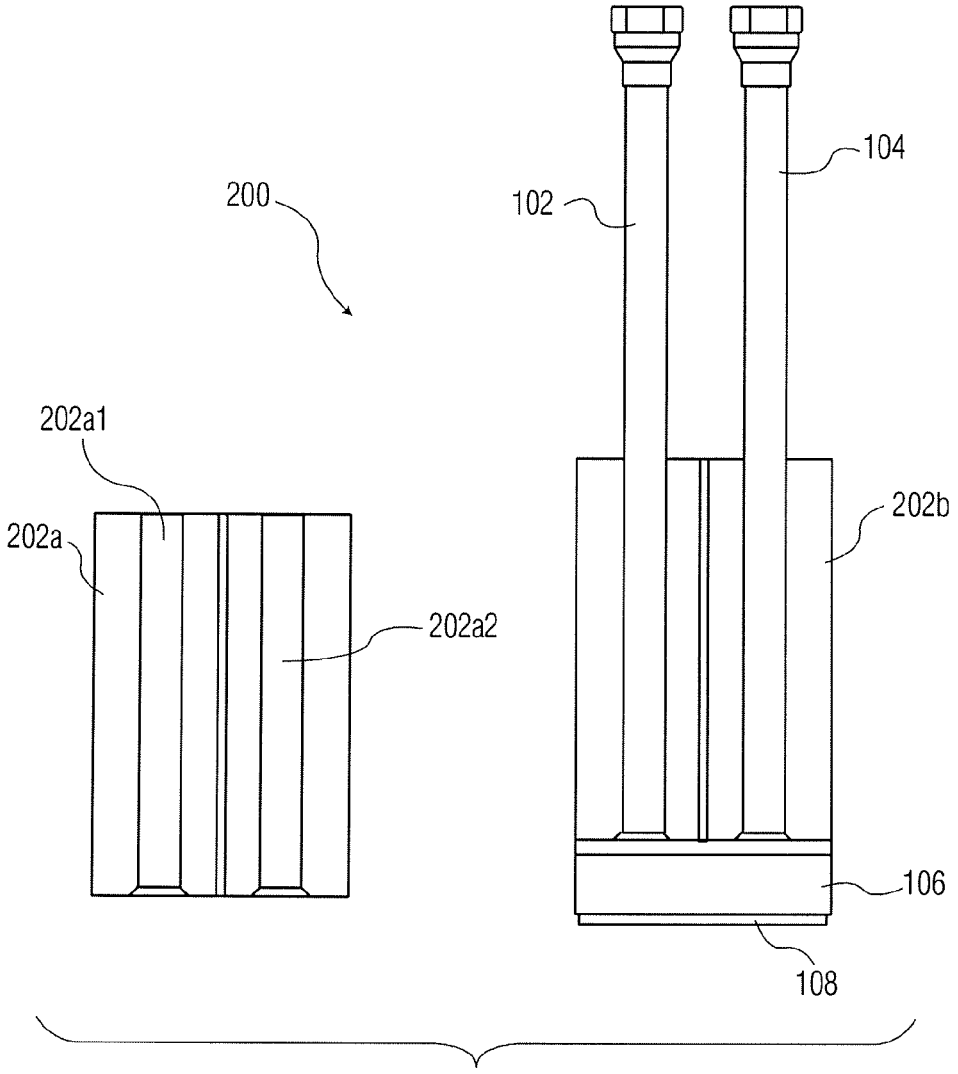
FIG. 2C is a top view of the lamp head assembly of FIG. 2A, with the upper thermally conductive plate separated from the remainder of the lamp head assembly, in accordance with an exemplary embodiment of the invention.
Figure 2D:
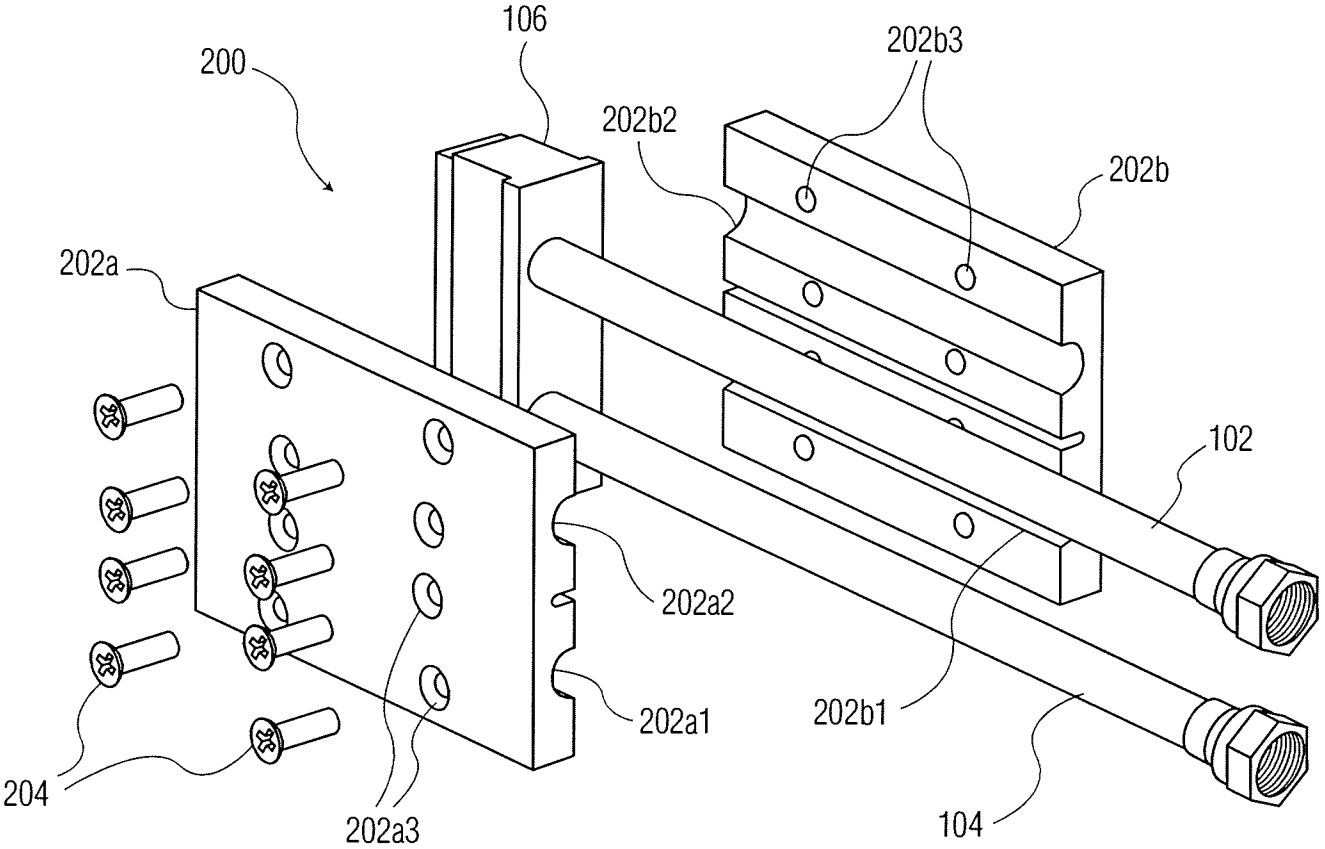
FIG. 2D is a side perspective exploded view of the lamp head assembly of FIG. 2A in accordance with an exemplary embodiment of the invention.

FIGS. 2A-2D provide various views of a lamp head assembly 200. Lamp head assembly 200 includes the same inlet cooling fluid pipe 102, outlet cooling fluid pipe 104, thermally conductive block 106, metal heat exchanger 108, and plurality of light producing elements 110—all shown and described above, for example, with respect to FIGS. 1A-1C. Lamp head assembly 200 also includes a pair of thermally conductive plates 202 (e.g., aluminum plate blocks) surrounding at least a portion of a length of inlet cooling fluid pipe 102, and a portion of outlet cooling fluid pipe 104. The pair of thermally conductive plates 202 includes an upper plate 202*a* and a lower plate 202*b* (the naming of the plates as "upper" and "lower" is arbitrary, and simply refers to the orientation shown in the drawings). As shown in FIGS. 2C-2D, each of upper plate 202*a* and lower plate 202*b* defines a cavity to receive a portion of inlet cooling fluid pipe 102 and outlet cooling fluid pipe 104. More specifically, upper plate 202*a* defines a first cavity 202*a*1 and a second cavity 202*a*2. Likewise, lower plate 202*b* defines a first cavity 202*b*1 and a second cavity 202*b*2. The cavities 202*a*1, 202*a*2, 202*b*1, and 202*b*2 are desirably arc shaped to closely resemble the outer shape of the respective portions of inlet cooling fluid pipe 102 and outlet cooling fluid pipe 104. Thus, the fit between (i) the cavities 202*a*1, 202*a*2, 202*b*1, and 202*b*2, and (ii) inlet cooling fluid pipe 102 and outlet cooling fluid pipe 104, is desirably a relatively tight fit—thereby providing for a good heat exchange therebetween. FIG. 2D illustrates plate fastening screws 204, and corresponding apertures 202*a*3 and 202*b*3, for securing upper plate 202*a* to lower plate 202*b*.

Figure 3A:
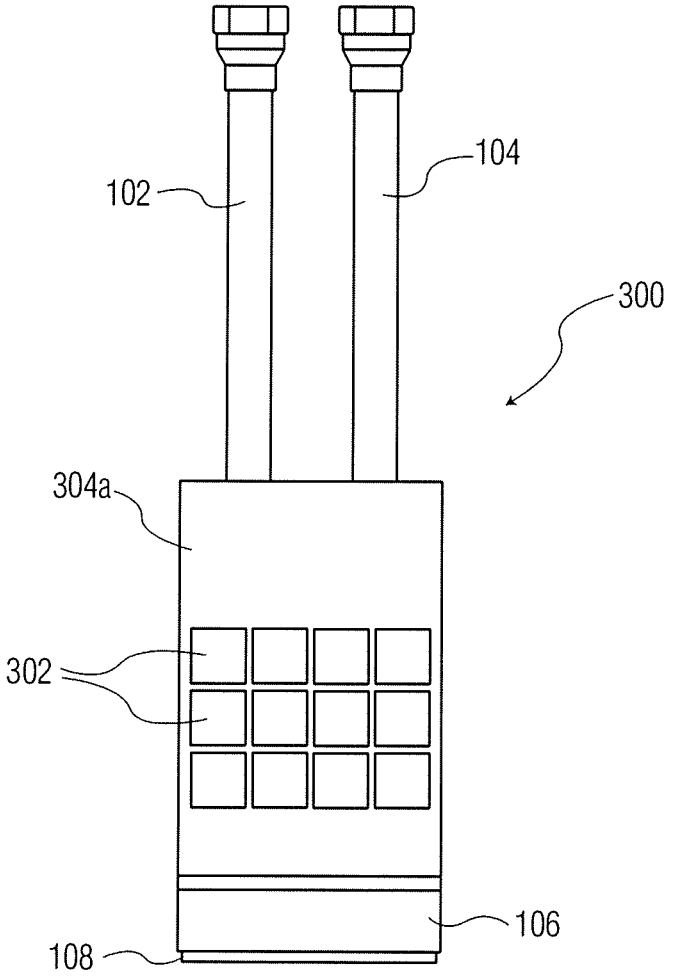
FIG. 3A is a top view of a lamp head assembly in accordance with yet another exemplary embodiment of the invention.
Figure 3B:
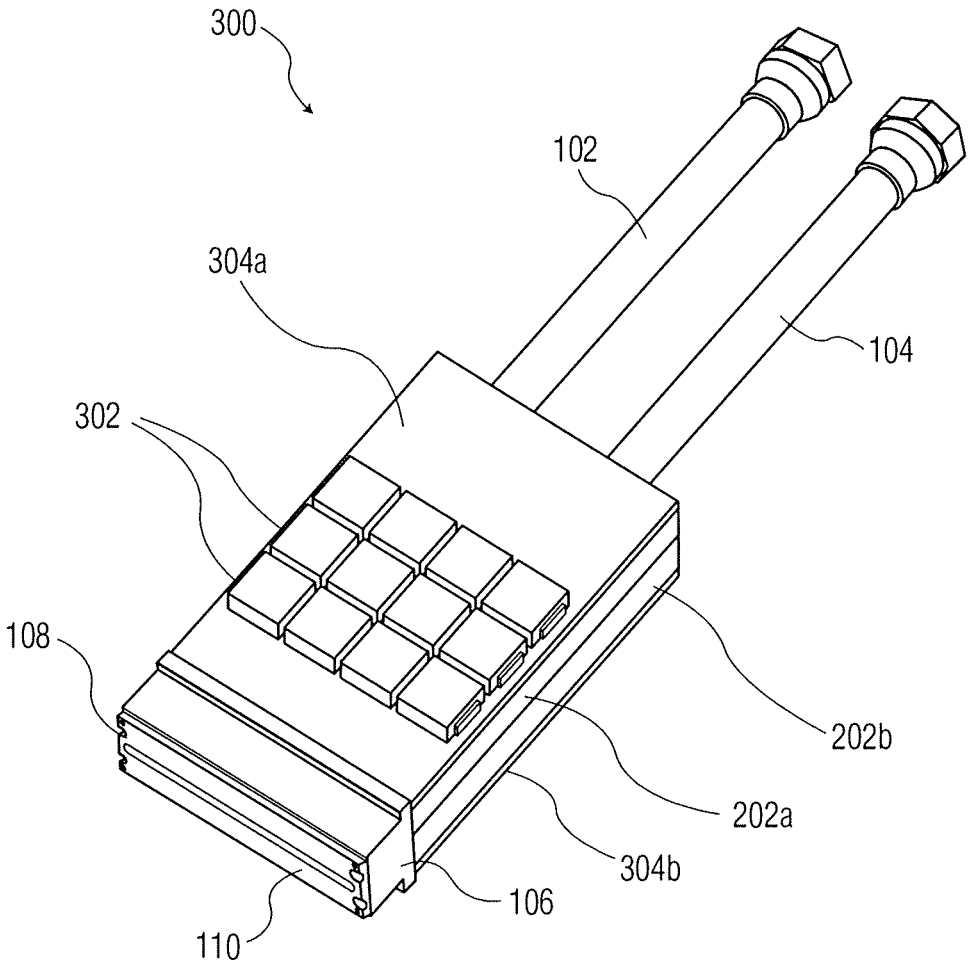
FIG. 3B is a top perspective view of the lamp head assembly of FIG. 3A in accordance with an exemplary embodiment of the invention.

FIGS. 3A-3B provide various views of a lamp head assembly 300. Lamp head assembly 300 includes the same inlet cooling fluid pipe 102, outlet cooling fluid pipe 104, thermally conductive block 106, metal heat exchanger 108, and plurality of light producing elements 110—all shown and described above, for example, with respect to FIGS. 1A-1C. Lamp head assembly 300 also includes the same pair of thermally conductive plates 202 (including upper plate 202*a* and lower plate 202*b*)—shown and described above with respect to FIGS. 2A-2D.

Lamp head assembly 300 also includes a circuit board 304*a* including a plurality of driver circuits 302 for providing electrical current to energize at least a portion of the plurality of light producing elements 110. Circuit board 304*a* is secured to a surface of upper plate 202*a*. While only partially visible in FIGS. 3A-3B, lamp head assembly 300 also includes another circuit board 304*b* including a plurality of driver circuits 302 (not visible) for providing electrical current to energize another portion of the plurality of light producing elements 110. Circuit board 304*b* is secured to a surface of lower plate 202*b*. As will be appreciated by those skilled in the art, the electrical current is provided by a power source (e.g., a remote power supply, not shown), where the electrical current may be modified, transformed, etc. (e.g., on circuit boards 304*a*, 304*b*) before application to the plurality of light producing elements 110. This electrical current is distributed to the various driver circuits 302, and then provided to the various light producing elements 110. Heat from the driving circuits 302 is somewhat dissipated by a thermal cooling path between inlet cooling fluid pipe 102 (and perhaps outlet cooling fluid pipe 104), upper plate 202*a*, lower plate 202*b*, circuit board 304*a*, and circuit board 304*b*.

Figure 4:
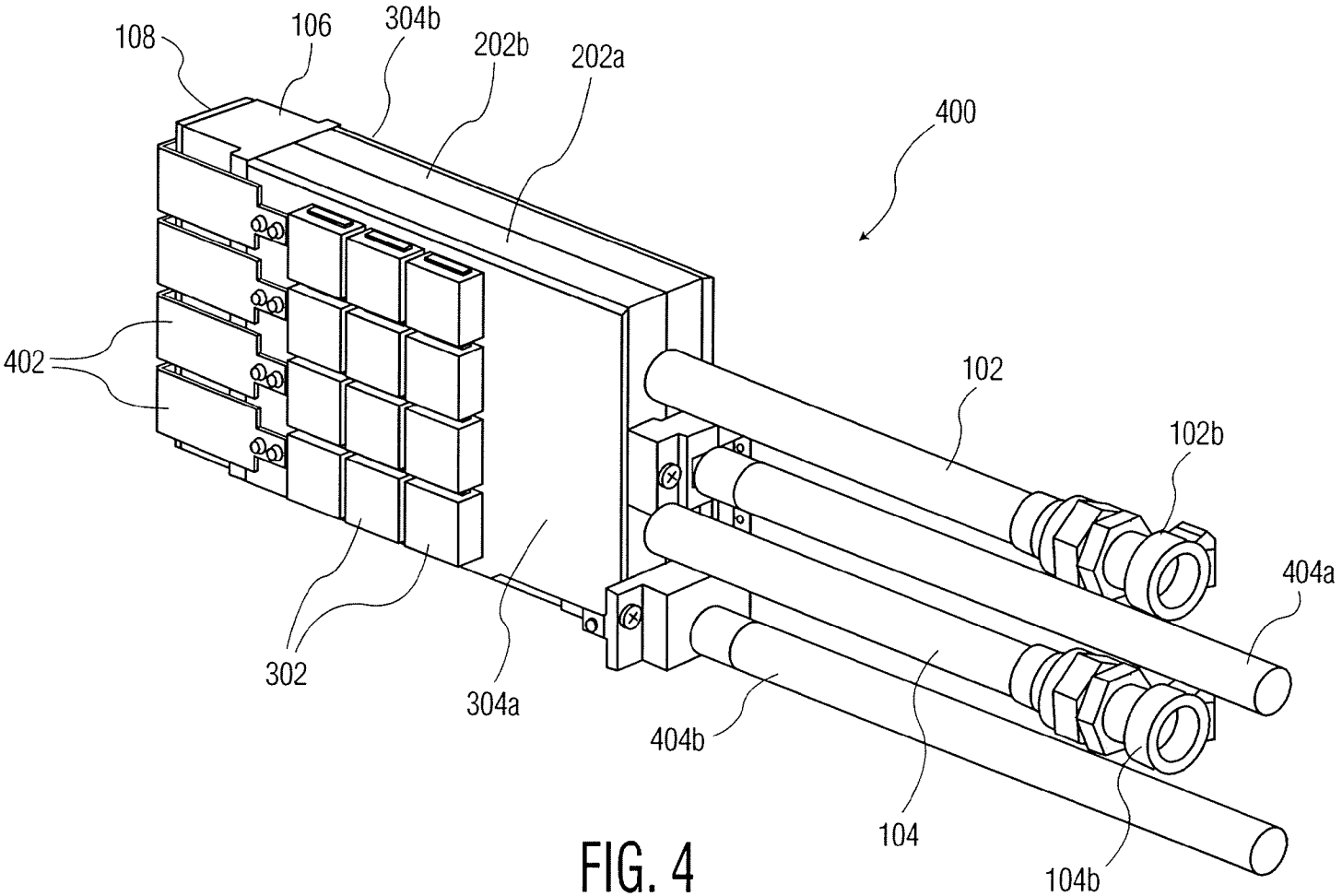
FIG. 4 is a side perspective view of a lamp head assembly in accordance with yet another exemplary embodiment of the invention.

FIG. 4 illustrates a lamp head assembly 400. Lamp head assembly 400 includes the same inlet cooling fluid pipe 102, outlet cooling fluid pipe 104, thermally conductive block 106, metal heat exchanger 108, and the plurality of light producing elements 110—all shown and described above, for example, with respect to FIGS. 1A-1C. Lamp head assembly 400 also includes the same pair of thermally conductive plates 202 (including upper plate 202*a* and lower plate 202*b*)—shown and described above, for example, with respect to FIGS. 2A-2D. Lamp head assembly 400 also includes the same circuit board 304*a*, circuit board 304*b*, and driver circuits 302—all shown and described above, for example, with respect to FIGS. 3A-3B.

Lamp head assembly 400 also includes conductors 402 (e.g., copper conducting bars) which provide current paths between the driver circuits 302 and the light producing elements 110. Lamp head assembly 400 also includes electrical cables 404*a*, 404*b* which provide electrical energy from a power source (e.g., a remote power supply, not shown). This electrical energy is distributed to the various driver circuits 302.

FIG. 4 also illustrates quick connect fittings 102*b*, 104*b* provided at an end of each of inlet cooling fluid pipe 102 and outlet cooling fluid pipe 104 (where the quick connect fittings 102*b*, 104*b* are engaged with the threaded copper tube fittings 102*a*, 104*a* shown in FIG. 1B).

In accordance with certain exemplary embodiments of the invention, an electrically continuous ground path is established that includes each of the inlet cooling fluid pipe, the outlet cooling fluid pipe, the thermally conductive block, the metal heat exchanger, and the pair of thermally conductive plates. The electrically continuous ground path is desirably configured to provide a ground path for electrical components of the lamp head assembly, such as electrical components included on the circuit boards (e.g., the driver circuits, etc.).

Figure 5:
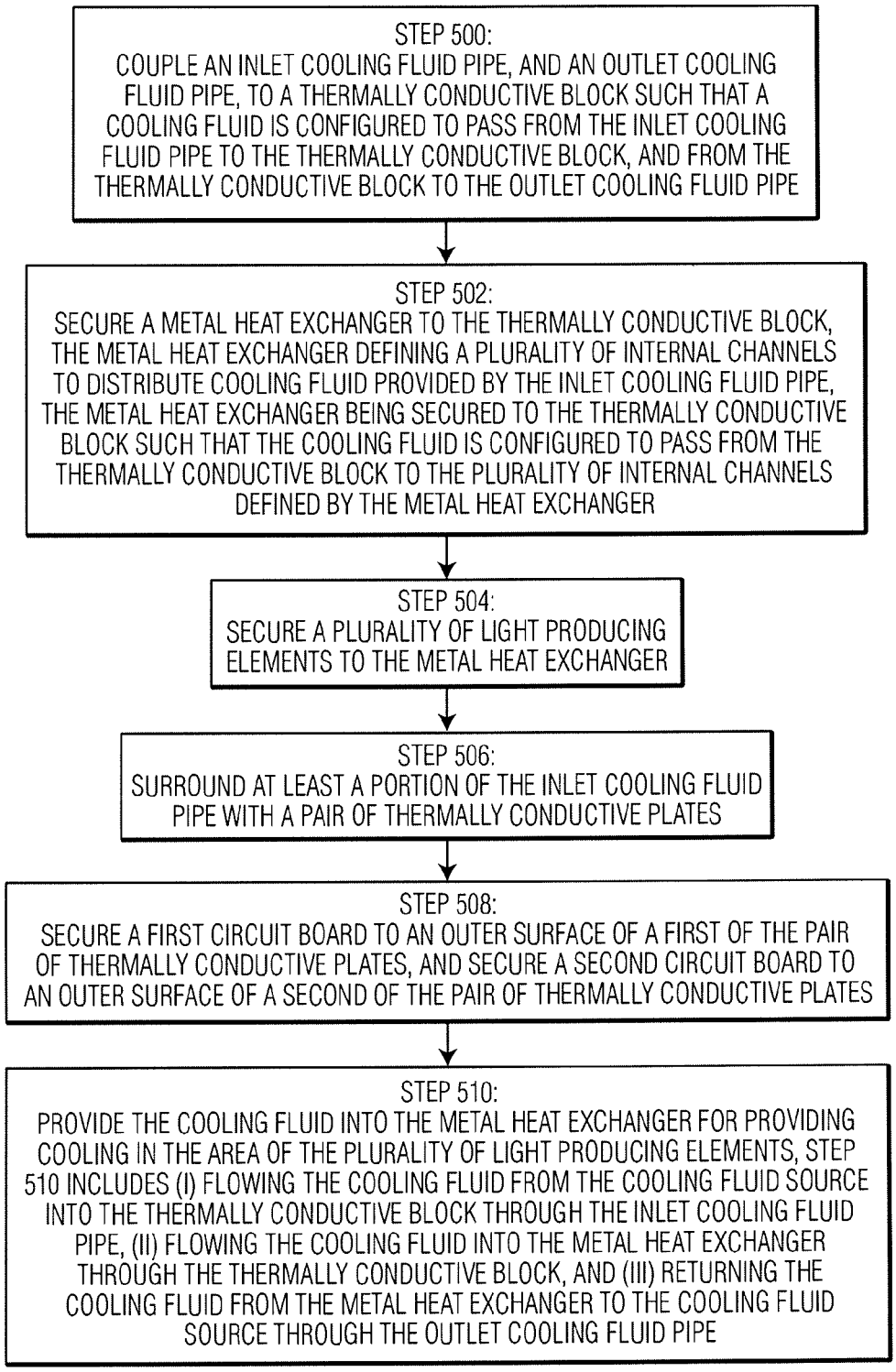
FIG. 5 is a flow diagram illustrating a method of assembling a lamp head assembly in accordance with an exemplary embodiment of the invention.

FIG. 5 is a flow diagram in accordance with certain exemplary embodiments of the invention. As is understood by those skilled in the art, certain steps included in the flow diagram may be omitted; certain additional steps may be added; and the order of the steps may be altered from the order illustrated.

Referring specifically to the flow diagram in FIG. 5, a method of assembling a lamp head assembly is provided. At Step 500, an inlet cooling fluid pipe and an outlet cooling fluid pipe (e.g., fluid pipes 102, 104 shown, for example, in FIGS. 1A-1C) are coupled to a thermally conductive block (e.g., thermally conductive block 106 shown, for example, in FIGS. 1A-1C) such that a cooling fluid is configured to pass from the inlet cooling fluid pipe to the thermally conductive block. At Step 502, a metal heat exchanger (e.g., metal heat exchanger 108 shown, for example, in FIGS. 1A-1C) is secured to the thermally conductive block. The metal heat exchanger defines a plurality of internal channels to distribute cooling fluid provided by the inlet cooling fluid pipe. The metal heat exchanger is secured to the thermally conductive block such that the cooling fluid is configured to pass from the thermally conductive block to the plurality of internal channels defined by the metal heat exchanger. At Step 504, a plurality of light producing elements (e.g., light producing elements 110 shown, for example, in FIG. 1C which may be a plurality of arrays of UV LED light producing devices) are secured to the metal heat exchanger.

At Step 506, at least a portion of each of the inlet cooling fluid pipe and the outlet cooling fluid pipe is surrounded with a pair of thermally conductive plates (e.g., thermally conductive plates 202*a*, 202*b* shown, for example, in FIGS. 2A-2D). More specifically, in Step 506, and with specific reference to FIGS. 2C-2D, a portion of inlet cooling fluid pipe 102 and outlet cooling fluid pipe 104 is aligned with respective cavities 202*a*1, 202*b*1, 202*a*2, and 202*b*2 such that a close fit is provided by the cavities and the cooling fluid pipes 102, 104 after assembly.

At Step 508, a first circuit board is secured to an outer surface of a first of the pair of thermally conductive plates (e.g., circuit board 304*a* shown, for example, in FIGS. 3A-3B is secured to thermally conductive plate 202*a*), and a second circuit board is secured to an outer surface of a second of the pair of thermally conductive plates (e.g., circuit board 304*b* shown, for example, in FIG. 3B is secured to thermally conductive plate 202*b*). The first circuit board includes a first plurality of driver circuits configured to provide electrical energy to ones of the plurality of light producing elements, and the second circuit board includes a second plurality of driver circuits configured to provide electrical energy to others of the plurality of light producing elements. For example, referring specifically to FIGS. 3A-3B, a plurality of driver circuits 302 are provided on each circuit board 304*a* and 304*b*, for providing electrical energy to certain ones of the light producing elements 110. For example, referring specifically to FIG. 4, conductors 402 (e.g., copper conducting bars) provide current paths between certain ones of the driver circuits 302 on each of circuit boards 304*a*, 304*b* and corresponding light producing elements 110.

At Step 510, cooling fluid is provided into the metal heat exchanger for providing cooling in the area of the plurality of light producing elements. This cooling of the plurality of light producing elements includes (i) flowing the cooling fluid from a cooling fluid source (e.g., a chiller) into the thermally conductive block through the inlet cooling fluid pipe, (ii) flowing the cooling fluid into the metal heat exchanger through the thermally conductive block, and (iii) returning the cooling fluid from the metal heat exchanger to the cooling fluid source through the outlet cooling fluid pipe.

Through the various embodiments of the invention described herein, an electrically continuous ground path is established between each of the inlet cooling fluid pipe, the thermally conductive block, and the metal heat exchanger—all of which may be formed of a metal material (e.g., copper). Such a path may provide an electrical ground connection for electrical components of the lamp head assembly, such as the plurality of driver circuits providing electrical current to energize the plurality of light producing elements.

Although various embodiments of the invention have illustrated the thermally conductive block (e.g., element 106 shown in the drawings) and the metal heat exchanger (e.g., element 108 shown in the drawings) as separate components, it is understood that these elements may be combined in a single element, and may be formed from a single piece of material (e.g., a single piece of copper material).

Although the invention is described with respect to certain light producing elements (e.g., UV LED elements), it is not limited thereto. For example, other UV light producing elements, as well as non-UV elements, are contemplated.

The light producing elements may be arranged in any desired configuration, for example, in rows and/or arrays of such elements.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A lamp head assembly comprising:

a thermally conductive block;

an inlet cooling fluid pipe coupled to the thermally conductive block such that a cooling fluid is configured to pass from the inlet cooling fluid pipe to the thermally conductive block;

a metal heat exchanger secured to the thermally conductive block, the metal heat exchanger defining a plurality of internal channels to distribute cooling fluid provided by the inlet cooling fluid pipe, the metal heat exchanger being secured to the thermally conductive block such that the cooling fluid is configured to pass from the thermally conductive block to the plurality of internal channels defined by the metal heat exchanger;

a plurality of light producing elements secured to the metal heat exchanger; and a pair of thermally conductive plates surrounding at least a portion of a length of the inlet cooling fluid pipe.

2. The lamp head assembly of claim 1 wherein the plurality of light producing elements are UV LED elements.

3. The lamp head assembly of claim 2, wherein cooling fluid provided to the metal heat exchanger is configured to remove heat produced by the UV LED elements.

4. The lamp head assembly of claim 1 wherein the pair of thermally conductive plates are aluminum plates.

5. The lamp head assembly of claim 4 further comprising an outlet cooling fluid pipe, wherein at least a portion of a length of the outlet cooling fluid pipe is surrounded by the pair of aluminum plates.

6. The lamp head assembly of claim 4 wherein each of the pair of aluminum plates defines a respective cavity to receive a portion of the inlet cooling fluid pipe.

7. The lamp head assembly of claim 4 wherein a circuit board including driver circuits for providing electrical current to energize at least a portion of the plurality of light producing elements is secured to a surface of one of the aluminum plates.

8. The lamp head assembly of claim 7 wherein another circuit board including driver circuits for providing electrical current to energize another portion of the plurality of light producing elements is secured to a surface of the other of the aluminum plates.

9. The lamp head assembly of claim 7 wherein the one of the aluminum plates receives a cooling effect from the inlet cooling fluid pipe, thereby removing heat produced by the driver circuits.

10. The lamp head assembly of claim 1 further comprising at least one electrical cable for providing electrical energy from a power source to the lamp head assembly for powering the plurality of light producing elements.

11. A lamp head assembly comprising:

a thermally conductive block;

an inlet cooling fluid pipe coupled to the thermally conductive block such that a cooling fluid is configured to pass from the inlet cooling fluid pipe to the thermally conductive block;

a metal heat exchanger secured to the thermally conductive block, the metal heat exchanger defining a plurality of internal channels to distribute cooling fluid provided by the inlet cooling fluid pipe, the metal heat exchanger being secured to the thermally conductive block such that the cooling fluid is configured to pass from the thermally conductive block to the plurality of internal channels defined by the metal heat exchanger; and a plurality of light producing elements secured to the metal heat exchanger, wherein an electrically continuous ground path is established between each of the inlet cooling fluid pipe, the thermally conductive block, and the metal heat exchanger.

12. The lamp head assembly of claim 11 wherein the electrically continuous ground path is configured to provide a ground path for electrical components of the lamp head assembly, the electrical components including a plurality of driver circuits providing electrical current to energize the plurality of light producing elements.

13. The lamp head assembly of claim 1 wherein the inlet cooling fluid pipe is coupled to the thermally conductive block using at least one of soldering, brazing, and welding.

14. The lamp head assembly of claim 1 wherein each of the thermally conductive block, the inlet cooling fluid pipe, and the metal heat exchanger is formed from a material including copper.

15. A method of assembling a lamp head assembly, the method comprising the steps of:

(a) coupling an inlet cooling fluid pipe to a thermally conductive block such that a cooling fluid is configured to pass from the inlet cooling fluid pipe to the thermally conductive block;

(b) securing a metal heat exchanger to the thermally conductive block, the metal heat exchanger defining a plurality of internal channels to distribute cooling fluid provided by the inlet cooling fluid pipe, the metal heat exchanger being secured to the thermally conductive block such that the cooling fluid is configured to pass from the thermally conductive block to the plurality of internal channels defined by the metal heat exchanger;

(c) securing a plurality of light producing elements to the metal heat exchanger; and (d) surrounding at least a portion of the inlet cooling fluid pipe with a pair of thermally conductive plates.

16. The method of claim 15 wherein the pair of thermally conductive plates are aluminum plates.

17. The method of claim 15 wherein step (d) includes aligning a portion of the inlet cooling fluid pipe with a cavity defined by each of the thermally conductive plates.

18. The method of claim 15 a further comprising a step of (e) securing a first circuit board to an outer surface of a first of the pair of thermally conductive plates, and securing a second circuit board to an outer surface of a second of the pair of thermally conductive plates, the first circuit board including a first plurality of driver circuits configured to provide electrical energy to ones of the plurality of light producing elements, the second circuit board including a second plurality of driver circuits configured to provide electrical energy to others of the plurality of light producing elements.

19. The method of claim 15 wherein step (a) also includes coupling an outlet cooling fluid pipe to the thermally conductive block such that the cooling fluid is configured to pass from the thermally conductive block to a cooling fluid source through the outlet cooling fluid pipe.

20. The method of claim 19 further comprising a step of providing the cooling fluid into the metal heat exchanger for providing cooling in the area of the plurality of light producing elements, the step of providing the cooling fluid including (i) flowing the cooling fluid from the cooling fluid source into the thermally conductive block through the inlet cooling fluid pipe, (ii) flowing the cooling fluid into the metal heat exchanger through the thermally conductive block, and (iii) returning the cooling fluid from the metal heat exchanger to the cooling fluid source through the outlet cooling fluid pipe.

* * * * *